United States Patent [19]

Roquencourt

[11] 3,949,405

[45] Apr. 6, 1976

[54] VERTICALLY POLARISED OMNIDIRECTIONAL ANTENNA

[75] Inventor: Jacques Roquencourt, Paris, France

[73] Assignee: Thomson-CSF, Paris, France

[22] Filed: Dec. 17, 1974

[21] Appl. No.: 533,709

[30] Foreign Application Priority Data

Dec. 21, 1973 France ..... 73.46035

[52] U.S. Cl. ..... 343/771

[51] Int. Cl.² ..... H01Q 13/12

[58] Field of Search..... 343/771, 770, 874

[56] References Cited

UNITED STATES PATENTS

| | | | |
|---|---|---|---|
| 2,455,224 | 11/1948 | Buchwalter et al. | 343/771 |
| 3,164,834 | 1/1965 | Nikolayuk | 343/771 |
| 3,189,908 | 6/1965 | Provencher | 343/771 |
| 3,871,000 | 3/1975 | Tymann | 343/771 |

*Primary Examiner*—Eli Lieberman
*Attorney, Agent, or Firm*—Cushman, Darby & Cushman

[57] ABSTRACT

A waveguide having a cross-section of oblong shape is pierced with two arrays of longitudinal slots located opposite one another, symmetrically in relation to the longitudinal plane of symmetry of the guide intersecting the cross-section thereof along its smaller dimension. In order to obtain the desired omnidirectional pattern, which requires that the distance between oppositely located slots should not be too great, a waveguide is used the greater dimension of the cross-section of which is reduced relatively to the value required by the operation frequency, and ridges or dielectric material are provided inside the guide for increasing its cut-off frequency.

1 Claim, 4 Drawing Figures

VERTICALLY POLARISED OMNIDIRECTIONAL ANTENNA

The present invention relates to an omnidirectional antenna, for radiating a vertically polarised wave, designed in the form of a slotted waveguide.

Omnidirectional antennas of this kind which are used in the centimeter waveband, have the advantage over antennas of the dipole array kind, that they need nothing more than a simple wave guide feeder instead of the complex kind of feeder system which otherwise has to be used in order to take account of each radiator element.

It is well-known to design omnidirectional antennas of this kind in the form of circular waveguides pierced by a network of slots.

The drawback of these omnidirectional antennas based upon circular waveguides, arises out of the fact that it is not a very easy matter to produce in a circular waveguide a propagation mode which will yield vertical polarisation when the latter is required.

The object of the present invention is an omnidirectional antenna for radiating a vertically polarised wave which combines the inherent feeder arrangement simplicity of antennas formed from circular waveguides, with the relative ease of design of antennas constituted by dipole arrays.

This result is achieved using slotted waveguide with an oblong cross-section, and additional elements.

It is further known, for example from U.S. Pat. No. 2,543,468, to design omnidirectional antennas for radiating a horizontally polarised wave by utilising waveguides having an oblong cross-section with a symmetry axis in the direction of its greater dimension; for that purpose the waveguides are pierced, in the direction of their length, with two arrays of longitudinal slots located opposite one another, symmetrically in relation to that one of the longitudinal symmetry planes of the waveguide which contains the above-mentioned symmetry axis. It would appear, at first sight, that, similarly, a vertically polarised omnidirectional waveguide antenna with an oblong cross-section could be obtained provided the cross-section of the waveguide shows a symmetry axis in the direction of its smaller dimension and the waveguide is pierced, in the direction of its length, with two arrays of transversal slots located opposite one another, symmetrically in relation to that one of the longitudinal symmetry planes containing the symmetry axis shown by the cross-section of the waveguide in the direction of its smaller dimension. As a matter of fact such antennas have not been designed because opposite slots are at a distance from each other which is equal to the greater dimension of the cross-section of the waveguide and so the elementary sources constituted by two opposite slots are at a distance from each other which is too great, relatively to the operation wave length, for the antenna to be considered as omnidirectional.

According to the invention there is provided an omnidirectional antenna for radiating a vertically polarised wave, comprising a waveguide with an oblong cross-section and a longitudinal plane of symmetry which cuts said cross-section in the direction of the smaller dimension thereof, said waveguide having a wall provided with two arrays of slots located opposite one another and arranged symmetrically in relation to said plane of symmetry; and a device located inside said waveguide for increasing the cut-off frequency thereof; and two identical metal plates, attached to the exterior of said waveguide and located in said plane of symmetry and extending over the whole length of said waveguide.

The invention will be better understood and other of its features rendered apparent from a consideration of the ensuing description and the related drawings in which.

Figure 1:
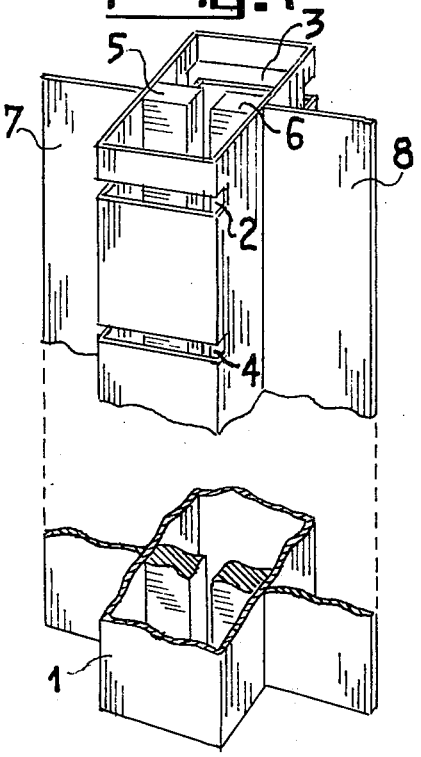
FIGS. 1 and 2 are fragmentary views of antennas in accordance with the invention.

FIG. 1 illustrates an antenna designed to produce an omnidirectional pattern in the azimuthal plane, with a vertically polarised wave. This antenna comprises a rectangular waveguide 1 with radiator slots such as 2 3 and 4. These slots have a perimeter substantially equal to the wavelength $\lambda$ of the wave to be transmitted by the waveguide 1, and are distributed in the form of two identical arrays, located opposite one another in the shorter sides of the waveguide, the longer sides of the slots in one and the same array being parallel with one another. Consecutive slots at one and the same side are arranged at variable intervals (for example at intervals ranging $\lambda_g/4$ and $2\ \lambda_g$, where $\lambda_g$ is the wavelength in the waveguide), this because of the distribution, in the waveguide 1, of the current lines which said slots must intersect in order to perform the function of radiation elements. Moreover, the oppositely disposed slots are arranged in order to radiate in phase.

Inside the waveguide 1 there are disposed two metal ridges 5, 6. The ridges extend over the whole length of the waveguide and are respectively attached to the two longer internal faces, at the centres thereof; the object of these ridges is to increase the cut-off frequency of the waveguide and thus allow the use of a waveguide having longer sides shorter than would be otherwise necessary and therefore making oppositely located slots sufficiently close to each other for the obtainment of an omnidirectional pattern.

At the centres of the longer sides of the ridged waveguide section, there are respectively attached two metal plates 7, 8, which extend over the whole length of the waveguide; the function of these plates is to correct the radiation patterns of the waveguide slots in order to promote the production of an omnidirectional pattern.

Figure 2:
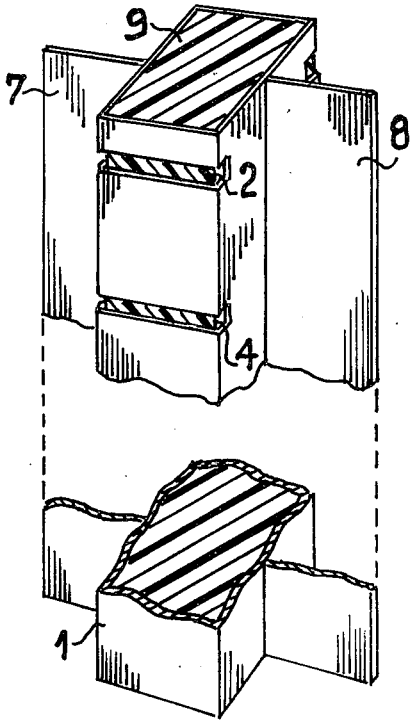

FIG. 2 illustrates an antenna which differs from that of FIG. 1 only in that a dielectric material 9 which fills the waveguide is substituted for the ridges. This material plays the same part as the ridges: to allow to reduce the dimensions of the greater side of the waveguide without reducing the cut-off frequency thereof.

In this case, as in the case of FIG. 1, the characteristics of the antenna remain the same:

- opposite slots radiating in phase;
- distance between opposite slots of the order of half the operating wavelength $\lambda$;
- slot perimeter substantially equal to the operating wavelength $\lambda$;
- variable distance between two consecutive slots of one and the same array (for example distance ranging between $\lambda_g/4$ and $2\ \lambda_g$ , where $\lambda_g$ is the wavelength in the waveguide).

It should be noted that in order to simplify matters, the slots have been shown in FIGS. 1 and 2, perpendicular to the major axis of the waveguide 1, although in reality the slots can be inclined to a greater or lesser extent, in order to modify the coupling between slot and waveguide and to bring the coupling factor to a level which contributes to the formation of the desired overall pattern.

Figure 3:
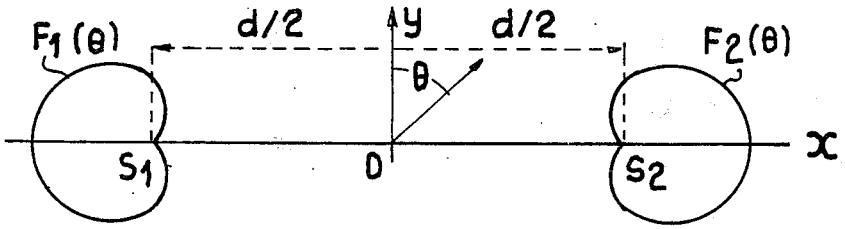
FIGS. 3 and 4 are diagrams which explain the operation of an antenna in accordance with the invention.

FIG. 3 illustrates, in a horizontal plane defined by two rectangular axes O$x$ and O$y$, elementary patterns of two elementary sources $S_1$ and $S_2$ whose respective co-ordinates are (—d/2, 0) and (+d/2, O), these sources not radiating to any substantial extent towards the rear, and radiating in phase.

If $\theta$ is the angle made by a given direction with the axis Oy and $F_1(\theta)$ and $F_2(\theta)$ the elementary patterns of the sources, then calculation shows that the total pattern $F_t$, in the case where the two sources are spaced by an interval corresponding to half a wavelength ($d = \lambda/2$), is given by:

$$F_t^2(\theta) = F_1^2\left(\theta - \frac{\pi}{2}\right) + F_2^2\left(\theta + \frac{\pi}{2}\right) + 2\,F_1\left(\theta - \frac{\pi}{2}\right) \cdot F_2\left(\theta + \frac{\pi}{2}\right) \cos(\pi \sin\theta)$$

The two elementary sources being chosen identical, $$F_1\left(\theta - \frac{\pi}{2}\right) = F_2\left(\theta + \frac{\pi}{2}\right).$$

Figure 4:
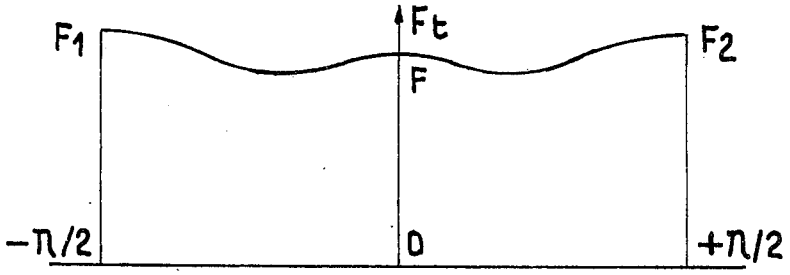

The graph representing $F_t$ as a function of $\theta$ is given in FIG. 4.

The two sources each contribute half to the radiation in the direction $\theta = 0°$ or $\theta = \pi$, while a single source $S_1$, yields the radiation at $-\pi/2$, and a single source $S_2$, the radiation at $+\pi 2$; thus, in order to have the same amplitude in the directions O, $\pi$, $-\pi/2$, and $+\pi/2$, it is necessary for the elementary pattern of a source to exhibit a drop of 6 dB between its peak value, that is to say as the case may be $\theta = -\pi/2$ or $\theta + \pi/2$, and its value for $\theta = 0°$ or $\theta = \pi$. It is as a function of these requirements that the precise position and direction of each slot will be determined.

It should be noted, moreover, that experiment, confirmed by calculation, has shown that the phase along the omnidirectional pattern, varies alternately between 0° and $\pi/2$.

An antenna such as that described in relation to FIG. 1, has been built for a transmitter operating at a frequency of 5000 MHz. The antenna measures around 2m in height; the longer side of the waveguide is 30 mm. the shorter side 20 mm; the ridges have a thickness of 2 mm and are spaced apart by 10 mm; the plates have a width of 30 mm.

The radiation pattern can be perfected, although at the expense of simplicity by utilising a waveguide which, such as the rectangular section waveguide, has an oblong cross-section and which enables the same modes of propagation as those occuring in a rectangular section waveguide to exist, while making it possible to form slots on curved surfaces; it may be, for example, a waveguide of elliptical cross-section or a waveguide whose cross-section exhibits two straight and parallel sides separated by a distance shorter than their own length and linked together by two arcuate portions.

Of course, the invention is not limited to the embodiments described and shown which were given solely by way of example.

What is claimed is:

1. An omnidirectional antenna for radiating a vertically polarised wave, comprising: a waveguide with an oblong cross-section and a longitudinal plane of symmetry which cuts said cross-section in the direction of the smaller dimension thereof, said waveguide having a wall provided with two arrays of slots located opposite one another and arranged symmetrically in relation to said plane of symmetry; a device located inside said waveguide for increasing the cut-off frequency thereof; and two identical metal plates, attached to the exterior of said waveguide and extending over the whole length thereof, said plates being located in said plane of symmetry.

* * * * *